US008616803B2

(12) United States Patent
Gebhart

(10) Patent No.: US 8,616,803 B2
(45) Date of Patent: Dec. 31, 2013

(54) PAVING STONE HAVING STONE FLANKS ORIENTED PREFERABLY PERPENDICULAR TO THE LAYING PLANE

(75) Inventor: Hans Gebhart, Memmingen (DE)

(73) Assignee: Baustoffwerke Gebhart & Soehne GmbH and Co. KG, Lachen (DE)

( * ) Notice: Subject to any disclaimer, the term of this patent is extended or adjusted under 35 U.S.C. 154(b) by 0 days.

(21) Appl. No.: 13/138,995

(22) PCT Filed: May 18, 2010

(86) PCT No.: PCT/EP2010/056796

§ 371 (c)(1), (2), (4) Date: Nov. 8, 2011

(87) PCT Pub. No.: WO2010/133582

PCT Pub. Date: Nov. 25, 2010

(65) Prior Publication Data

US 2012/0057933 A1 Mar. 8, 2012

(30) Foreign Application Priority Data

May 19, 2009 (DE) ..... 10 2009 022 017

(51) Int. Cl.
*E01C 5/00* (2006.01)
*E04B 5/04* (2006.01)

(52) U.S. Cl.
USPC ..... 404/38; 404/37; 52/603

(58) Field of Classification Search
USPC ..... 404/37–41; 52/392, 603, 604
See application file for complete search history.

(56) References Cited

U.S. PATENT DOCUMENTS

| | | | | | |
|---|---|---|---|---|---|
| 1,314,278 | A * | 8/1919 | McClain | 404/38 |
| 3,464,328 | A * | 9/1969 | Van Der Meijden | 404/41 |
| 4,067,196 | A * | 1/1978 | Schraudenbach | 405/16 |
| D389,926 | S * | 1/1998 | Barth et al. | D25/113 |
| 6,178,715 | B1 * | 1/2001 | Pacitto et al. | 52/604 |
| 6,536,988 | B2 * | 3/2003 | Geiger | 404/39 |
| 7,220,078 | B2 * | 5/2007 | Drost et al. | 404/38 |
| 7,850,394 | B2 * | 12/2010 | Schroder | 404/38 |
| 7,950,873 | B2 * | 5/2011 | Geiger | 404/39 |
| 2002/0104283 | A1 * | 8/2002 | Geiger | 52/603 |
| 2008/0101860 | A1 * | 5/2008 | Scheiwiller | 404/42 |
| 2009/0097916 | A1 * | 4/2009 | Schroder | 404/41 |

FOREIGN PATENT DOCUMENTS

| | | | |
|---|---|---|---|
| DE | 198 24 556 | A1 | 12/1999 |
| DE | 100 13 613 | A1 | 10/2001 |
| DE | 201 09 608 | U1 | 12/2001 |
| DE | 103 30 928 | A1 | 2/2005 |
| DE | 20 2004 008 747 | U1 | 10/2005 |
| DE | 20 2008 000 194 | U1 | 4/2008 |
| EP | 1 036 882 | A1 | 9/2000 |
| EP | 1 108 815 | A2 | 6/2001 |
| EP | 1 335 069 | A2 | 8/2003 |

* cited by examiner

*Primary Examiner* — Thomas B Will
*Assistant Examiner* — Abigail A Risic
(74) *Attorney, Agent, or Firm* — Paine Hamblen, LLP

(57) ABSTRACT

The present invention relates to a paving stone having stone flanks which are oriented perpendicular to the laying plane, and wherein the paving stone has interlocking elements of a stone flank of an adjacent paving stone.

3 Claims, 6 Drawing Sheets

PAVING STONE HAVING STONE FLANKS ORIENTED PREFERABLY PERPENDICULAR TO THE LAYING PLANE

RELATED PATENT DATA

The present patent application claims priority from German Patent Application Serial No. 10 2009 022 017.8, and which was filed on May 19, 2009, and PCT/EP2010/056796, and which was filed on May 18, 2010.

The invention relates to a paving stone having stone flanks oriented preferably perpendicular to the laying plane, wherein interlocking elements corresponding to interlocking elements of a stone flank of an adjacent stone are configured on the stone flanks.

A paving stone of the generic type is known from DE 103 30 928 B4.

Paving stones, in particular for road building, are often realized as interlocking systems for reasons of security against displacement. These interlocking systems are based on the principle that interlocking elements arranged on a stone flank engage in the interspaces between the interlocking elements, arranged in the grid, on the flank of the adjacent paving stone in order, in concert with the joint filler, to prevent mutual displacement of the stones. Paving stones in which interlocking elements are arranged on all stone flanks in a predefined grid, which interlocking elements engage all the way round irrespective of the position of the paving stones one to another, are widely used. In this system, the stones have a defined top side and bottom side.

When the paving stones are laid, efforts must be made to ensure the stones have as far as possible no mutual contact, but are separated from one another by joint material. This ensures that no damage due to temperature fluctuations and associated material expansions can occur.

From EP 1 036 882 B1, it is known to provide artificial stones for paving purposes with interlocking portions, on which a spacer is arranged in order to secure a minimum distance between the stones. The spacer is here configured such that it is at least partially destroyed when the laid paving is compacted.

DE 201 09 608 UI discloses an artificial stone for paving purposes, in which a portion holder is applied to an interlocking portion, so that the portion holder butts against the stone flank of an adjacent paving stone and a minimum gap between the interlocking portions is thereby ensured. DE 201 09 608 U1 also discloses that a spacer is applied directly to the stone flank of a stone, which spacer interacts with an interlocking element of an adjoining paving stone such that the interlocking element hits the spacer applied to the stone flank, whereby a minimum gap is once again said to be ensured.

DE 198 24 556 B4 discloses a concrete paving stone, in which two adjacent stone flanks have longer teeth than the two other adjacent stone flanks. To the longer teeth on the respectively opposing stone flanks of the concrete paving stone, recesses are assigned. As a result, a change of gap width is said to be possible.

It is a drawback with the previously known systems that these systems are not applicable to stones having larger dimensional tolerances, since the clearances which are then necessary between the interlocking elements would lead to the accumulation of dimensional differences over a plurality of stones.

The generic document discloses a concrete paving stone which has interlocking elements of different widths. An interlocking element is here said to have a width which substantially corresponds to the clear width between two adjacent, narrow interlocking elements of an adjacent paving stone. The interspace between two narrow interlocking elements is here said to be many times larger than the width of a narrow interlocking element. In addition, the number of narrow interlocking elements is said to be a multiple of the number of wide interlocking elements. The use of interlocking elements of different width is said to have the effect, on the one hand, that in the region of the narrow interlocking elements large horizontal clearances are formed between the interlocking elements of adjacent stones, which horizontal clearances provide sufficient tolerance when different-sized stones are put together. On the other hand, by virtue of the wider interlocking elements, which substantially correspond in width to the clear width between two narrow interlocking elements, two stones are said to be fixed together at multiple points. In this way, the accumulation of dimensional differences or laying errors over several stones is said to be prevented. At the same time, the wide chambers formed between the narrow interlocking elements is said to allow the reception of coarser and more effective joint material in the joints. Where necessary, the wide interlocking element can be provided with a buffer pocket, which can receive the squeezed concrete material. In one embodiment of DE 103 30 928 A4, a thickening can be provided between two narrow interlocking elements. The thickening is said to prevent a full-faced contact between two adjacent paving stones. It can also be provided that one or more narrow interlocking elements are realized such that they are elongated perpendicular to the stone flank and thus serve as protruding spacers.

In respect of the generic document, it is disadvantageous that at the places at which a wider interlocking element is introduced between two narrow interlocking elements, no or a no longer adequate amount of joint material, in particular sand, can be introduced. This is obtained in respect of the generic document by virtue of the fact that the wide interlocking element, in order that this can fulfill its function, must be fitted as engagingly as possible between two narrow interlocking elements.

The object of the present invention is to provide a paving stone in which the contact surface between two adjacent paving stones is largely minimized and which enables a suitable quantity of joint material to be introduced between two adjacent paving stones, the aim being to prevent the accumulation of dimensional differences or laying errors over several stones.

This object is achieved according to the invention.

The fact that the paving stone has at each stone flank at least two configurations of interlocking elements, which differ at least in that the interlocking elements of one configuration are elongated in a direction perpendicular to the stone flank in relation to the interlocking elements of the other configuration, means that two mutually adjoining paving stones do not touch by way of all interlocking elements, but rather contact merely exists by way of the elongated interlocking elements. The contact surface between the stones is thereby minimized. The stones are separated from one another, in particular including in the region of the non-elongated interlocking elements, by joint material, in particular sand.

These features are realized equally both in the inventive solution as claimed.

In the inventive solution as claimed, it is further provided that the interlocking elements configured on the stone flanks are respectively arranged in a grid spacing, so that the interlocking elements respectively have a uniform horizontal distance to adjacent interlocking elements of the same stone flank. It is here provided that all interlocking elements, irrespective of whether it is a question of normal interlocking elements or interlocking elements elongated perpendicular to the stone flank, are arranged in the predefined grid spacing. By a predefined grid spacing is meant that the interlocking elements respectively have a uniform, horizontal distance of, for instance, 25 mm to adjacent interlocking elements of the same stone flanks.

According to the invention, it is provided that on the stone flanks respectively at least two interlocking elements, within their position between two interlocking elements or an interlocking element and a vertical stone edge, are offset inversely to one another such that the two interlocking elements are disposed outside of the grid spacing. Between the offset interlocking elements should here be found at least one interlocking element arranged in the grid spacing. The fact that two interlocking elements are located outside of the grid spacing and that the interlocking elements are offset inversely to one another achieves the effect in a simple and advantageous manner that the offset interlocking elements, once the paving stone is laid, are no longer located centrally between two interlocking elements of an adjoining paving stone. The offset interlocking elements are thus brought closer to one of the interlocking elements of the adjacent paving stone. The inverse offsetting of the two offset interlocking elements here means that an offset interlocking element ensures that the paving stone is limited in relation to an adjoining paving stone in terms of a displacement to the right, while the other offset interlocking element limits a displacement of the paving stone to the left. As a result of the two offset interlocking elements, two adjacent paving stones can be connected to each other in a defined manner according to the notion of a key/lock principle, so that dimensional differences or laying errors cannot be accumulated over several stones.

The inventive solution has the advantage over the generic document, DE 103 30 928 B4, that more joint material, in particular sand, can be introduced. With the "key element", i.e. the wider interlocking element, according to DE 103 30 928 B4, it was not possible, or only very limitedly possible, to introduce sand to the place at which the wide interlocking element fills the space between two narrow interlocking elements of an adjacent paving stone. By contrast, the inventive solution enables the use of a key/lock principle without the introduction of sand into the interspaces between two interlocking elements being substantially impaired. In particular, each interlocking element of the paving stone can be filled sufficiently with sand, at least from one side, or sand can appropriately adjoin the interlocking element.

The tolerance dimension of the key/lock system according to the invention can be determined by the measure by which the interlocking elements offset inversely to one another are arranged offset or outside of the grid spacing. In trials it has proved suitable in respect of a 25 mm grid spacing to offset the interlocking elements respectively by 1.5 mm. That is to say that an offset of about 6% of the grid spacing or an offset of between 2% and 20% of the grid spacing has proved particularly suitable for allowing a defined laying of the interlocking elements.

A pointwise fixing of two mutually adjoining paving stones by virtue of the inventive solution is also aided by the fact that both paving stones can boast the inventively offset interlocking elements.

It is advantageous if between the two offset interlocking elements are arranged at least two interlocking elements, preferably three interlocking elements, which are positioned within the grid spacing.

In trials, this has proved particularly suitable with respect to a flexible use of the paving stone and the introduction of joint material.

It is also advantageous if on each stone flank one of the offset interlocking elements is arranged between a vertical stone edge and an interlocking element arranged in the grid spacing. It has further proved particularly suitable if one of the offset interlocking elements of each stone flank adjoins a vertical stone edge. The paving stone is thus able to be positioned particularly favorably in the laying process.

It is preferably provided that each vertical stone edge is adjoined by precisely one offset interlocking element. Such a configuration allows flexible use of the stones without the paver having to pay attention to how the stone must be positioned. It can here be provided, for instance, that an offset interlocking element is configured either always to the left or always to the right of the stone edge.

According to the invention, it can also be provided that the offset interlocking elements are configured such that they are elongated in a direction perpendicular to the stone flank in relation to the interlocking elements arranged in the grid spacing.

The offset interlocking elements thus fulfill, apart from their key/lock function, also the function of spacers. The offset interlocking elements thus ensure that two adjacent paving stones make contact only by way of the offset interlocking elements and thus a minimum joint width is guaranteed, in particular including between the normal interlocking elements, i.e. those arranged in the grid spacing, and an opposite stone flank.

In principle, it is also possible according to the invention to configure one or more of the interlocking elements arranged in the grid spacing such that they are elongated in a direction perpendicular to the stone flank. The functionality of the key/lock function does not have to be combined with the "distance function". It is also conceivable to lengthen one or more of the offset interlocking elements and one or more of the interlocking elements arranged in the grid spacing in a direction perpendicular to the stone flank.

It is advantageous if, in respect of a paving stone having a square base area, the interlocking elements on the four stone flanks are arranged respectively identically. That is to say that all four stone flanks boast the same number of interlocking elements, which are arranged on a respectively identical position. The paving stone can thus be used without the paver having to worry about its alignment.

It is advantageous if the interlocking elements extend only over a part of the stone height. It is thereby possible for a particularly large amount of joint material to be introduced between two paving stones, in particular including in the region of the interlocking elements.

It is preferably provided that the interlocking elements extend upward from the bottom side of the paving stone, yet end already prior to reaching the stone top side, preferably 20 mm+/−10 mm prior to reaching the stone top side. It is here also advantageous that the interlocking elements are thus not visible in the laid state, particularly if joint material is introduced between the paving stones.

It is preferable if the interlocking elements are arranged only in the lower region of the stone flanks in order to allow continuous filling with joint material in the upper region of the stone flanks. When looking from above onto the laid paving, the observer therefore gains the impression of a unitary continuous joint.

The interlocking elements do not necessarily have to start from the bottom side of the stone, instead the interlocking elements can also have a distance to the bottom side of the paving stone and, where necessary, be interrupted.

It is advantageous if the thickness of the interlocking elements, extending perpendicular to the stone flank, tapers in the direction of the stone top side. Preferably, the interlocking elements here end already prior to reaching the stone top side.

According to the invention, it can also be provided that individual interlocking elements arranged in the grid spacing are dispensed with, so that the distance between two adjacent interlocking elements arranged in the grid spacing increases by an integral multiple of the grid spacing. In principle, an even distribution of the interlocking elements along the stone flank is preferable, however. In a simple embodiment, individual interlocking elements arranged in the grid spacing can also however be dispensed with.

For specific applications of the paving stone, it can be advantageous if, in the middle of a stone flank, one or two interlocking elements arranged in the grid spacing are dispensed with. In principle, one or two interlocking elements arranged in the grid spacing and located between the two offset interlocking elements can also be dispensed with.

It is advantageous if no more than one or two interlocking elements arranged in the grid spacing are dispensed with per stone flank.

In trials it has proved that a grid of 10-50 mm, i.e. a distance of 10-50 mm between the center points of two interlocking elements, is particularly suitable as the grid spacing. A grid spacing of 25 mm+/−5 mm is quite especially suitable.

According to the invention, it can be provided that the thickness, extending perpendicular to the stone flank, of the offset interlocking elements measures 3-6 mm, preferably 4.5 mm+/−0.5 mm. It can further be advantageous if the thickness, extending perpendicular to the stone flank, of the interlocking elements arranged in the grid spacing measures 2-5 mm, preferably 3.5 mm+/−0.5 mm.

The thickness quoted with respect to the offset interlocking elements relates to the fact that the offset interlocking elements likewise fulfill the distance function. Where this is not the case, the offset interlocking elements can have the same thickness as the interlocking elements arranged in the grid spacing. Only those interlocking elements which are intended to guarantee the distance function are produced with an oversize.

It is advantageous if the interlocking elements which assume the distance function, at least at specific points, protrude about 1 mm+/−0.5 mm further than the interlocking elements without distance function.

According to the invention, it can be provided that the interlocking elements which are intended to guarantee the distance function have a greater width than the interlocking elements which do not fulfill a distance function.

The greater width of the interlocking elements with distance function implies, given the same angle (course in the direction of the protruding tip of the interlocking element), that the interlocking elements with distance function project over the interlocking elements without distance function. Alternatively, it can also be provided that the interlocking elements have the same width, yet the interlocking elements with the distance function taper at a more acute angle perpendicular to the stone flank. It is also possible to provide the interlocking elements with the same width and the same angle. In this case, a different rounding at the tip of the interlocking elements can achieve the effect that the interlocking elements with distance function jut out further. These variants can also be mutually combined according to choice.

According to an embodiment of the inventive solution, each stone flank has, instead of two interlocking elements, respectively only one interlocking element, which within its position between two interlocking elements or a vertical stone edge and an interlocking element is offset in such a way that the offset interlocking element is disposed outside of the grid spacing. According to the invention, it is further provided that to each vertical stone edge is assigned precisely one offset interlocking element. The offset interlocking elements are positioned on their stone flanks such that all interlocking elements have the same distance to the associated stone edge of the respective stone flank.

The fact that each offset interlocking element is arranged at the same distance to a stone edge and precisely one offset interlocking element is assigned to each stone edge achieves a specific arrangement of the offset interlocking elements which allows the paving stones to be laid in a simple manner in interlocking arrangement. By virtue of the inventive solution, it can be provided, for instance, that an offset interlocking element is located at each stone edge to the left or right of the stone edge and, irrespective of the stone edge from which a start is made, the distance to the offset interlocking element is respectively the same.

Unlike certain embodiments of the inventive solution, one embodiment has the drawback that no exact key/lock positioning is realized by the offset interlocking elements. Only placement of the offset interlocking element against a flank of an interlocking element of an adjoining paving stone is possible. By placement is here meant that, in the laying of the paving stones, the paving stones can respectively be put together in a defined manner and the paving stones are thus positionable. The paving stones can be displaced, however, such that the offset interlocking element moves away from the flank of the interlocking element against which it bears. Nevertheless, it has proved in trials that the possibility of a defined placement in the laying of the paving stones is already helpful and laying errors are thereby avoided.

The embodiments described can be realized analogously also with respect to other embodiments of the inventive solution, and vice versa.

An illustrative embodiment of the invention is described in basic representation below with reference to the drawing, wherein:

FIG. 4 shows a top view of a special stone, which differs from the stone represented in FIG. 1 in that at two opposite stone flanks an interlocking element arranged in the grid spacing is respectively dispensed with;

Figure 8B:
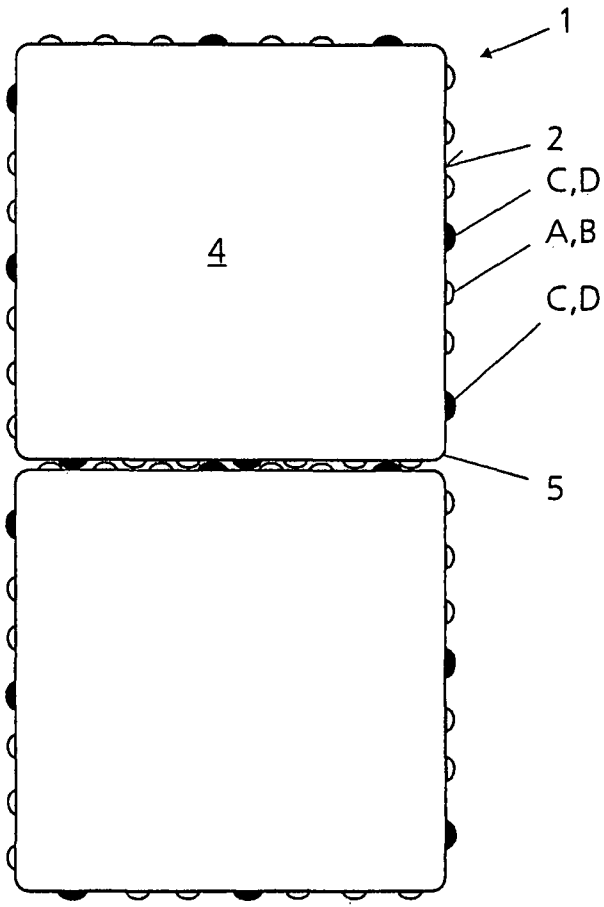
Figure 8A:
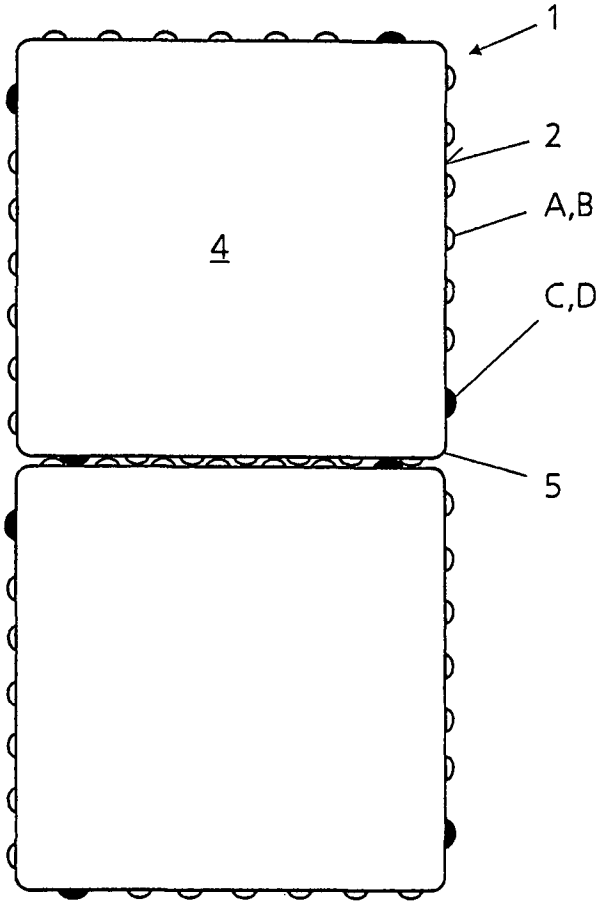
Figure 9:
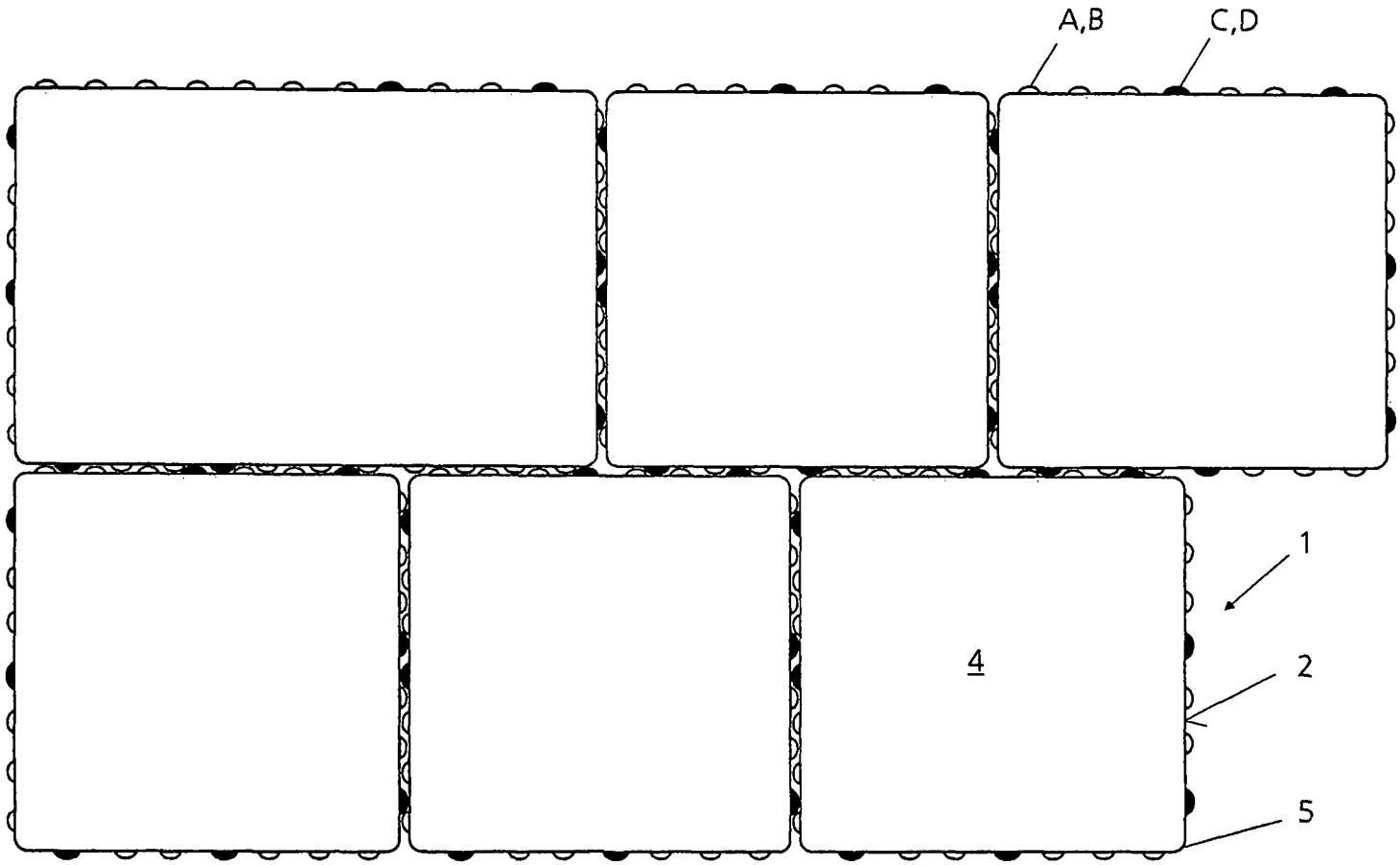

FIG. 8*a* shows a representation of two adjacently arranged paving stones, in which an interlocking element is offset respectively at each stone flank;

FIG. 8*b* shows a representation of two adjacently arranged paving stones, in which two interlocking elements are offset respectively at each stone flank; and FIG. 9 shows a laying example.

Paving stones can be formed from any chosen suitable material, for instance from concrete, clinker, fired clay or other materials usable for paved areas.

The paving stone 1 represented in the illustrative embodiment consists of a concrete basic element and has stone flanks 2 oriented perpendicular to the laying plane. On the stone flanks 2 are configured interlocking elements (A, B, C, D) corresponding to interlocking elements of a stone flank 2 of an adjacent paving stone 1. In the illustrative embodiment, each stone flank 2 has two configurations of interlocking elements (A and B) and (C and D), which differ at least in that the interlocking elements C and D of one configuration are elongated in a direction perpendicular to the stone flank 2 in relation to the interlocking elements A and B of the other configuration. Within the meaning of the invention, the configurations of the interlocking elements differ at least by their extent in a direction perpendicular to the stone flank 2. That is to say, interlocking elements are regarded as belonging to another configuration only when their maximum extents in a direction perpendicular to the stone flank 2, i.e. their thickness, differ from one another. If the maximum extent (perpendicular to the stone flank 2) of two paving stones is equal, then the interlocking elements are assigned to the same configuration, even if they otherwise differ considerably, for example in terms of course, width, etc.

In the illustrative embodiment, the interlocking elements C and D are elongated in a direction perpendicular to the stone flank 2 (see, in particular, FIGS. 1, 3, 4, 5 and 7). The interlocking elements A and B have a smaller thickness extending perpendicular to the stone flank 2.

Figure 3:
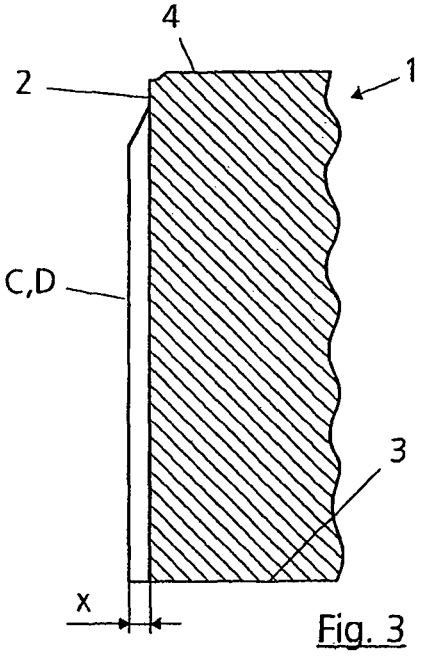
FIG. 3 shows a section along the line III-III of FIG. 1.

In the illustrative embodiment it is provided that the interlocking elements C and D have a thickness extending perpendicular to the stone flank 2 of 4.5 mm. This is denoted in FIG. 3 by the reference symbol x. In the illustrative embodiment it is further provided that the interlocking elements C and D have a course as represented in cross section in FIG. 3. That is to say, the interlocking elements C and D extend from a stone bottom side 3 in the direction of a stone top side 4, yet end prior to reaching the stone top side 4. The interlocking elements C and D taper in the direction of the stone top side 4, as represented in FIG. 3.

Figure 2:
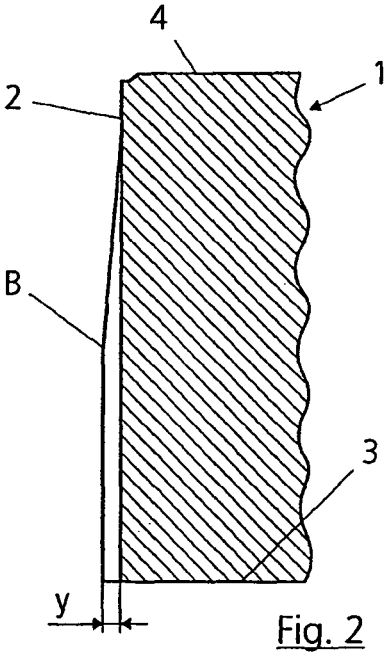
FIG. 2 shows a section along the line II-II of FIG. 1.

In the illustrative embodiment it is provided that the interlocking elements A and B have a thickness extending perpendicular to the stone flank 2 of 3.5 mm. This is denoted in FIG. 2 by the reference symbol y. The interlocking elements A and B, starting from the stone bottom side 3, likewise extend in the direction of the stone top side 4 without reaching the stone top side 4. The interlocking elements A and B taper in the direction of the stone top side 4. It is here provided that the interlocking elements B taper in the manner as represented in FIG. 2. The interlocking elements A have a course as represented in FIG. 3 with respect to the interlocking elements C and D, without however having the thickness thereof.

Figure 1:
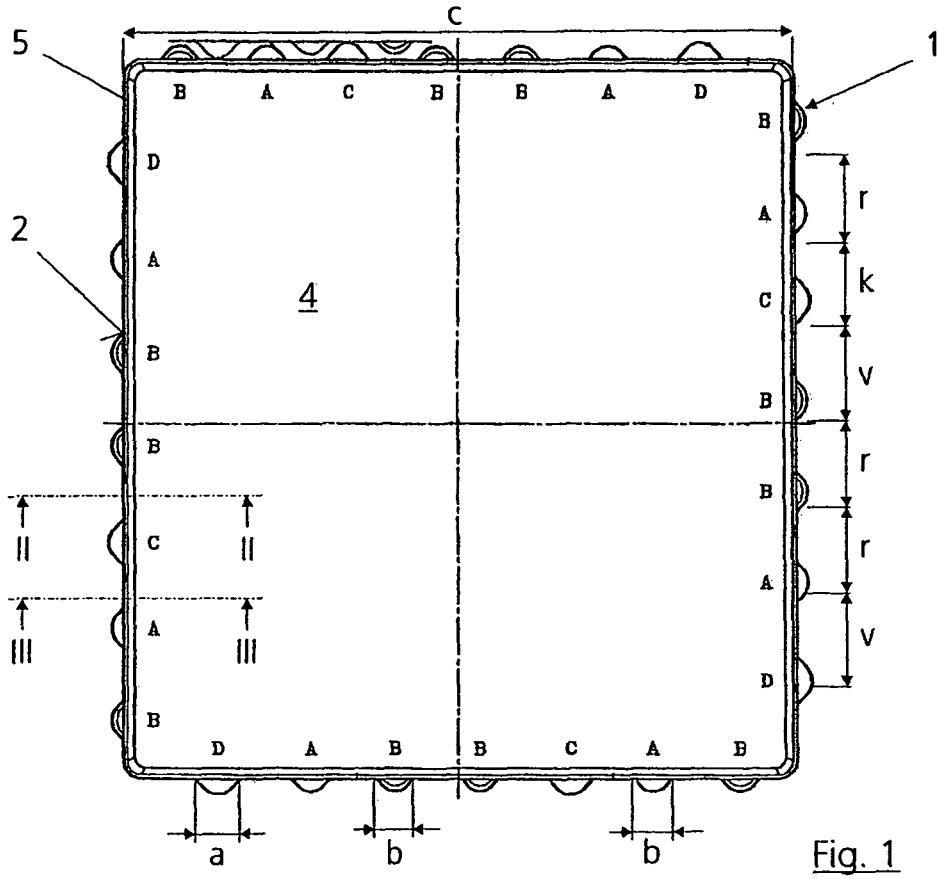
FIG. 1 shows a top view of a paving stone in which on the stone flanks respectively two interlocking elements are offset inversely to one another, so that the two interlocking elements are disposed outside of the grid spacing.

As is evident from FIG. 1, the interlocking elements configured on the stone flanks 2 are respectively arranged in a grid spacing, so that the interlocking elements respectively have a uniform horizontal distance to adjacent interlocking elements of the same stone flank 2. The grid spacing measures in the illustrative embodiment 25 mm, i.e. the distance between an interlocking element A and an interlocking element B and between an interlocking element B and an interlocking element B measures in the illustrative embodiment 25 mm, respectively calculated from the middle of the interlocking element A, B to the middle of the adjoining interlocking element A, B. On each stone flank 2, respectively two interlocking elements C, D, within their position between two interlocking elements A, B or an interlocking element A, B and a vertical stone edge 5, are offset inversely to one another such that the two interlocking elements C, D are disposed outside of the grid spacing. Between the offset interlocking elements are found in the illustrative embodiment three interlocking elements A, B, which are arranged in the grid spacing. In the 35 illustrative embodiment according to FIG. 1, it is provided that the offset interlocking elements C, D are offset by 1.5 mm to the grid spacing. The interlocking elements C, D are here respectively offset outward by 1.5 mm in the direction of the respectively adjacent stone edge 5. In the laid state of the paving stone 1, the interlocking elements D thus provide protection against displacement to the left, while the interlocking elements C provide protection against displacement to the right. The paving stone 1 represented in FIG. 1 has uniformly long side flanks 2, which respectively have a length of 195 mm (denoted by the reference symbol c in FIG. 1).

In the illustrative embodiment according to FIG. 1, the width of the interlocking elements C and D measures 13.1 mm (reference symbol a). In the illustrative embodiment according to FIG. 1, the width of the interlocking elements A and B is chosen at 11.1 mm (reference symbol b in FIG. 1). The values are quoted +/−10%.

As is further evident from FIG. 1, adjoining each stone edge 5 there is respectively arranged precisely one offset interlocking element D. That is to say, on each stone flank 2, one of the offset interlocking elements D is arranged between the vertical stone edge 5 and an interlocking element A arranged in the grid spacing.

As is evident from FIG. 1, the paving stone 1 is designed with a square base area, the interlocking elements A, B, C, D being respectively identically arranged on the four stone flanks 2.

Figure 4:
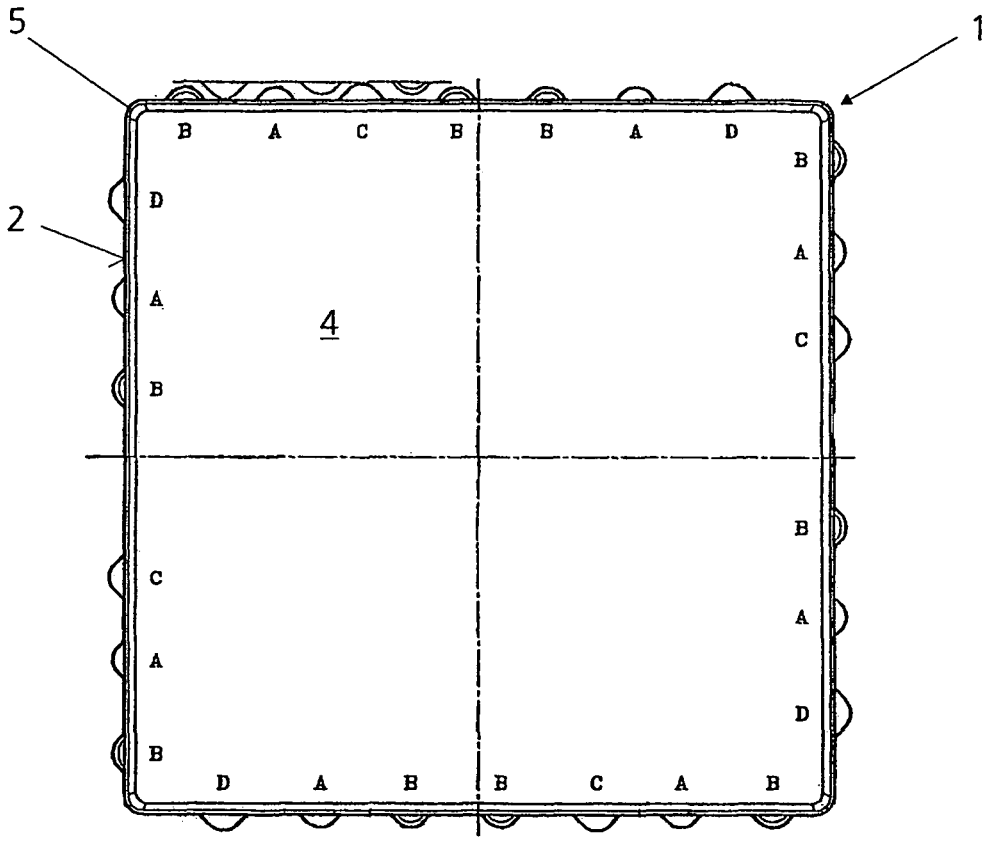

FIG. 4 shows an alternative embodiment of a paving stone 1 to that of FIG. 1. This paving stone differs from FIG. 1 only in that at two opposite stone flanks 2 an interlocking element A, B is respectively dispensed 35 with. The distance between two adjacent interlocking elements A, B arranged in the grid spacing is here increased by an integral multiple of the grid spacing. In the illustrative embodiment, on the two stone flanks 2, in the region of the middle of the stone flank 2, an interlocking element B is respectively dispensed with. That is to say, the distance between two interlocking elements A and B has increased by a multiple, between which interlocking elements, in the illustrative embodiment, is also found an offset interlocking element C.

Figure 5:
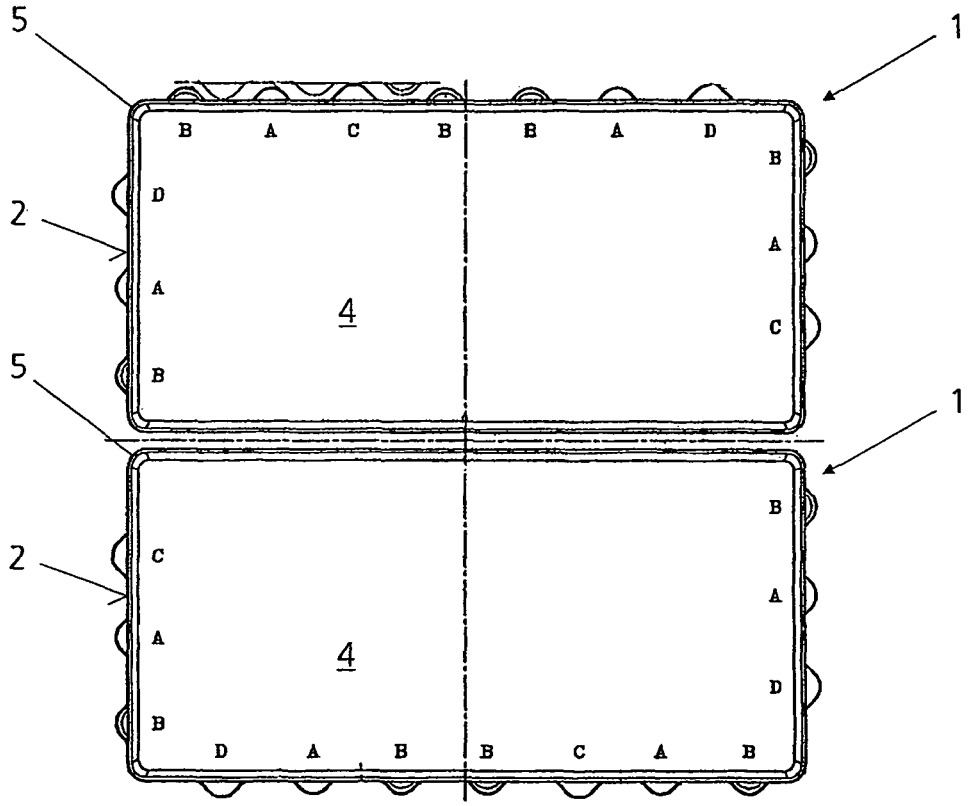
FIG. 5 shows a top view of two paving stones which are formed by the division of a paving stone according to FIG. 4.

FIG. 5 differs from FIG. 4 in that the paving stone 1 represented in FIG. 4 is divided into two halves. The division is here realized such that the paving stone 1 according to FIG. 4 is split into two equally large halves. Hence only three stone flanks 2 of the paving stone 1 continue to have interlocking elements A, B, C, D. This, too, is intended to be covered by the inventive solution.

A stone of this type is suitable for special applications.

Figure 6:
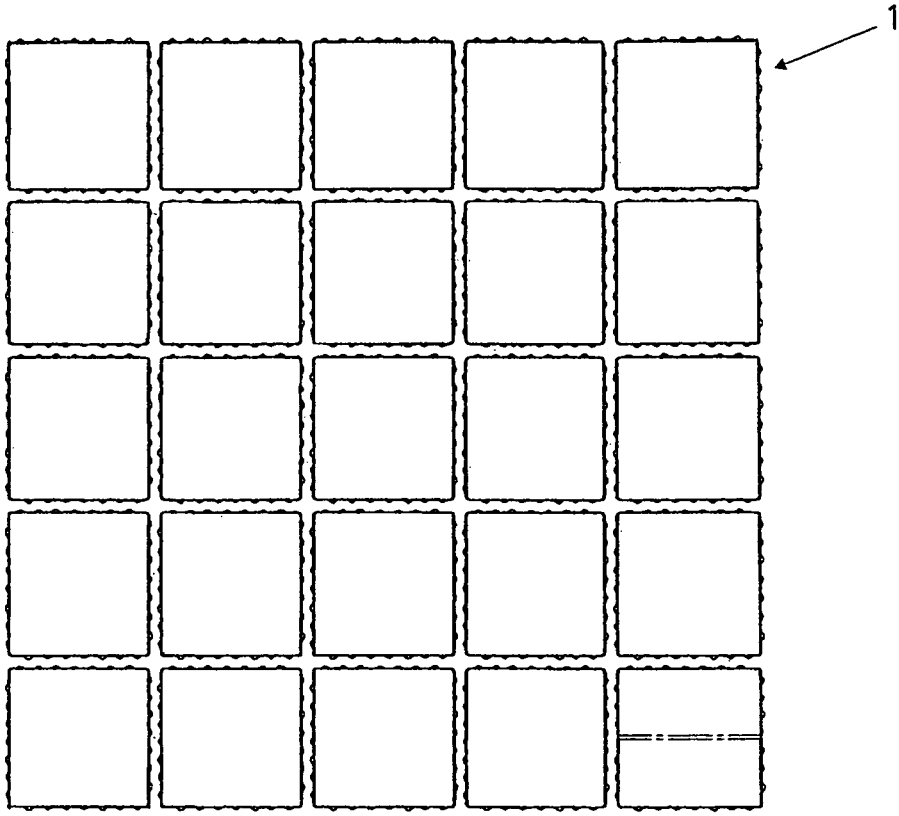
FIG. 6 shows a possible composition of a stone pack formed by the paving stones according to the invention.

FIG. 6 shows a possible arrangement of paving stones 1 according to the invention in a stone pack, i.e. in a state in which these can be delivered to a construction site. At the same time, two paving stones 1 according to FIG. 5 are also represented.

Figure 7:
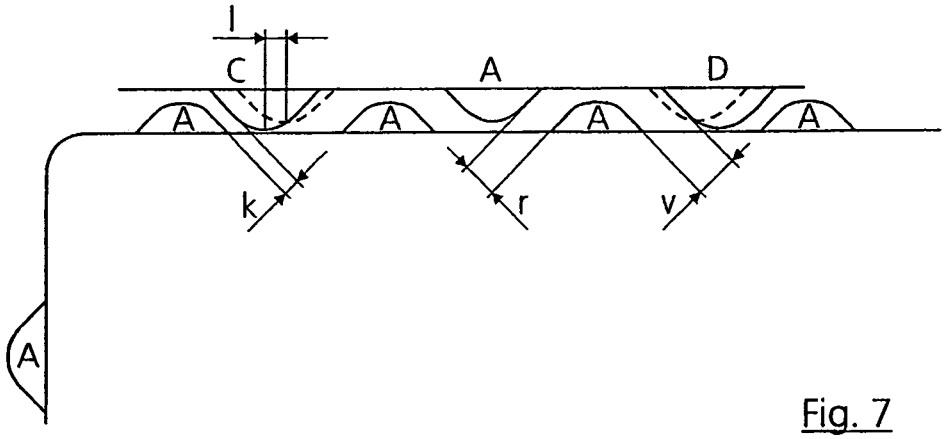
FIG. 7 shows a detailed representation of two offset interlocking elements, between which is positioned an interlocking element arranged in the grid spacing.

FIG. 7 shows in detail two offset interlocking elements C, D adjoining a stone flank 2 of an adjacent paving stone 1. In the illustrative embodiment represented in FIG. 7, the offset interlocking elements C, D are respectively inversely offset outward by 2.5 mm (reference symbol 1). The original position (in the grid spacing) is illustrated in FIG. 7 in dashed representation. The distance between the offset 35 interlocking elements C and D and respectively an interlocking element A of an adjacent paving stone 1 is thereby reduced to 2 mm, while the distance to the interlocking element A from which the interlocking element C is further remote is increased to 7 mm. The shortened distance is represented in FIG. 7 with the reference symbol k, while the increased distance is represented with the reference symbol v. The measure by which the interlocking elements C, D are offset in relation to the original position is defined in FIG. 7 with the reference symbol 1. The reference symbol r denotes the regular distance apart (4.5 mm) of two interlocking elements arranged in the grid spacing.

As is evident from FIG. 7, the key/lock principle is able to be exactly adjusted according to requirement by suitable offsetting of the interlocking elements C, D.

FIG. 8*b* shows a possible joining together of two paving stones 1, which have on each stone flank 2 respectively two offset interlocking elements C and D. For reasons of clarity, the offset interlocking elements C and D are illustrated in blackened representation in FIG. 8*b*. The non-offset interlocking elements, i.e. the interlocking elements A, B which are located in the grid spacing, are illustrated in non-blackened representation in FIG. 8*b*.

In FIG. 8*b*, the offset interlocking elements C or D are respectively displaced such that the interlocking elements C or D have moved farther apart. Alternatively thereto, the interlocking elements C or D can also however be offset inversely to one another such that the interlocking elements C or D lie closer together. In both cases, a suitable key/lock principle is obtained. As is further evident from FIG. 8, the offset interlocking elements C or D once again fulfill the distance function, i.e. they are configured such that they are elongated perpendicular to the stone flank 2.

FIG. 8*a* shows basically an arrangement according to FIG. 8*b*, though only one interlocking element C or D is configured on each stone flank 2. This corresponds to the inventive solution as claimed in claim 16. The interlocking element C or D arranged on a stone flank 2 is respectively assigned to a vertical stone edge 5. The interlocking elements C or D respectively have an identical distance measured from the associated vertical stone edge 5.

In the illustrative embodiment according to FIG. 8*a*, the paving stone 1 has a square base area. Furthermore, all stone flanks 2 are identically provided with interlocking elements C, D and A, B. In principle, the offset interlocking element C or D does not have to be arranged directly contiguous to a vertical stone edge 5. It is equally conceivable for the offset interlocking element C or D to be positioned between two interlocking elements A, B arranged in the grid spacing. According to the invention, it should however be ensured according to claim 16 that the offset interlocking elements C or D respectively have the same distance to the associated vertical stone edge 5. This applies even when the paving stone 1 in question is not a square paving stone 1.

As can be seen from FIG. 8*a*, the offset interlocking elements C or D essentially serve to enable the paving stone 1 to be placed in a defined manner against an adjoining paving stone 1 or its interlocking elements A, B. The upper paving stone 1 in FIG. 8*a* can no longer be displaced to the left in relation to the lower paving stone 1, since this is prevented by the offset interlocking elements C or D. The upper paving stone 1 can however be displaced to the right. The solution represented in FIG. 8*a* thus offers no "key/lock principle", as represented in FIG. 8*b*, but allows only a defined placement.

FIG. 9 shows six stones which are laid to form a paving and which are respectively provided on their side flanks 2 with two interlocking elements C, D. As is evident from FIG. 9, the inventive solution not only enables stones of the same size to be optimally laid, but stones of different size can also be combined with one another. It is also possible to lay the paving stone 1 according to the invention in cross bond, or else, as represented, in stretcher bond. The interlocking elements illustrated in blackened representation in FIG. 9 are once again constituted by the offset interlocking elements C, D. The interlocking elements A, B illustrated in non-blackened representation are constituted by the interlocking elements A, B arranged in the grid spacing. The interlocking elements C, D according to FIG. 9 also once again fulfill a distance function.

With the inventive solution, paving stones 1 can be produced with any chosen format, including, for instance, pentagonal or hexagonal stones.

The invention claimed is:

1. A paving stone, comprising:

a main body having a multiplicity of substantially vertically oriented stone flanks, and wherein each of the stone flanks terminate at opposite corners;

a multiplicity of interlocking elements A and B which are positioned in spaced relation along, and further extend perpendicularly outwardly relative to the respective stone flanks, and wherein the respective interlocking elements A and B are oriented in a predetermined grid pattern;

an interlocking element C which extends perpendicularly outwardly relative to the respective stone flanks to a distance which is greater than the interlocking elements A and B, and which is further located between the opposite corners of the respective stone flanks; and an interlocking element D which extends perpendicularly outwardly relative to the respective stone flanks to a distance which is greater than the interlocking elements A and B, and which is further located in an adjacent, spaced relationship relative to an adjoining corner, and wherein no intervening interlocking elements A or B are located between the interlocking element D, and the adjoining corner, and wherein the interlocking elements C and D are located outside of the predetermined grid spacing in an inversely offset orientation, one relative to the other, and wherein each of the interlocking elements C and D come into contact with a flank of an adjacent paving stone having a similar construction, and further rest in movement restraining contact with the interlocking elements A or B of the adjacent paving stone so as to prevent any substantial shifting movement of the respective paving stones, one relative to the other, and while simultaneously forming a predetermined seam between the adjacent paving stones and which receives a filler material therein.

2. A paving stone, comprising:

a main body having a multiplicity of substantially vertically oriented stone flanks, and wherein each of the stone flanks terminate at opposite corners; and a multiplicity of interlocking elements A, B, C and D which are located in predetermined spaced relation along each of the stone flanks, and wherein the multiplicity of interlocking elements A and B, are oriented along the respective stone flanks in a predetermined grid spacing, and the individual interlocking elements C and D, which are also located along the respective stone flanks, are located in an inversely offset relationship one relative to the other, and are further oriented outside of the predetermined grid spacing, and wherein the interlocking element D of each flank is located in substantially equally spaced relation relative to the adjacent corner of the main body, and wherein there are no interlocking elements A or B which are located between interlocking element D and the adjacent corner, and wherein interlocking element C is located between the opposite ends of each flank, and wherein an interlocking element A or B is located between the interlocking elements C and D, and between the interlocking element C, and one of the corners of the main body, and wherein each of the interlocking elements C and D come into contact with a flank of an adjacent paving stone having a similar construction, and further rest in movement restraining contact with the interlocking elements A or B of the adjacent paving stone so as to simultaneously prevent a shifting movement from occurring between the adjacent paving stones, and further locates the remaining interlocking elements A and B of each paving stone in substantially equally spaced relation relative to the interlocking elements A or B of the adjacent paving stone, and wherein a predetermined seam is formed between the adjacent paving stones, and receives a filler material therein.

3. A paving stone, comprising:

a main body having top and bottom surfaces, and stone flanks extending between the top and bottom surfaces, and wherein the stone flanks each have opposite ends, and a given length, and height dimension, and wherein the respective stone flanks are further substantially perpendicular relative to a predetermined laying plane, and the top and bottom surfaces, and wherein each of the opposite ends of the respective stone flanks adjoin an adjacent stone flank at a corner; and a multiplicity of elongated, interlocking elements, A, B, C, and D, and which are made integral with each of the stone flanks, and which are spaced along, and extend perpendicularly, outwardly relative to the respective stone flanks, and wherein immediately adjacent pairs of interlocking elements, A or B, are equally spaced, one relative to the other, along each of the respective stone flanks, and further extend perpendicularly outwardly relative to each of the stone flanks to substantially the same distance, and wherein the respective elongated, interlocking elements, C and D extend perpendicularly outwardly relative to each of the stone flanks at a given distance which is greater than the distance of the interlocking elements A and B, and wherein the elongated, interlocking element D is located on one end of each of the respective stone flanks, and wherein each interlocking element D is positioned in equally spaced relation relative to the adjacent corner, and wherein there are no interlocking elements A or B located between the interlocking element D, and the adjacent corner, and wherein the elongated interlocking element C is located at a predetermined position which is between the opposite ends of each of the stone flank, and wherein an interlocking element A or B, is located between one of the opposite ends of the respective stone flanks, and the elongated interlocking element C, and between the elongated interlocking elements C and D, and wherein the elongated interlocking elements C and D are operable to come into contact with the flank of an adjacent paving stone having a similar construction, and further are each located in a juxtaposed relationship relative to the elongated locking elements A or B of the adjacent paving stone, and wherein the elongated interlocking elements A and B are located in a predetermined grid spacing, and the elongated interlocking elements C and D are located outside of the predetermined grid spacing, and wherein the elongated interlocking elements C and D are offset inversely to each other so as to form a seam having a given width, and which further prevents a shifting movement of the paving stones one relative to the other, and wherein the elongated locking elements C and D are received between the elongated locking elements A or B of the adjacent paving stone, and wherein the remaining elongated locking elements A and B of each adjacent stone do not come into contact with each other, and are substantially equally spaced from each other so as to form the predetermined seam which receives a filler material therein.

* * * * *